US010952284B2

(12) United States Patent
Schluter et al.

(10) Patent No.: US 10,952,284 B2
(45) Date of Patent: Mar. 16, 2021

(54) HEATING CABLE

(71) Applicant: Schluter Systems, LP, Plattsburgh, NY (US)

(72) Inventors: Werner Schluter, Iserlohn (DE); Christian Babilon, Iserlohn (DE); Gilles Gagnon, Quebec (CA)

(73) Assignee: Schluter Systems L.P., Plattsburgh, NY (US)

( * ) Notice: Subject to any disclaimer, the term of this patent is extended or adjusted under 35 U.S.C. 154(b) by 232 days.

(21) Appl. No.: 16/039,619

(22) Filed: Jul. 19, 2018

(65) Prior Publication Data

US 2020/0029394 A1 Jan. 23, 2020

(51) Int. Cl.

| | |
|---|---|
| ***H05B 3/56*** | (2006.01) |
| ***H01C 7/02*** | (2006.01) |
| ***H01B 9/00*** | (2006.01) |
| ***H01B 7/02*** | (2006.01) |

(52) U.S. Cl.

CPC ..... *H05B 3/56* (2013.01); *H01B 7/02* (2013.01); *H01B 9/006* (2013.01); *H01C 7/02* (2013.01)

(58) Field of Classification Search

CPC ... H05B 3/58; H05B 3/54; H05B 3/40; H05B 3/46; H05B 3/145; H05B 3/56; H05B 2203/013; H05B 2203/02; H05B 2203/021; H05B 2203/022; H05B 2203/012; H05B 2203/026; B29C 63/0017; B29C 63/0073; B29C 65/4825; B29C 70/30; B29K 2677/10; B29K 2683/00; B29K 2705/12; B29L 2023/005; F16L 53/30; F16L 53/00; F16L 53/32; F16L 53/35; F16L 53/37; F16L 53/38; H01B 7/02; H01B 9/006; H01C 7/02

See application file for complete search history.

(56) References Cited

U.S. PATENT DOCUMENTS

| | | | | |
|---|---|---|---|---|
| 2,719,278 A * | 9/1955 | Kernen | ..... | H01R 4/5033 439/429 |
| 3,619,560 A | 11/1971 | Buiting et al. | | |
| 3,792,192 A | 2/1974 | Plate | | |

(Continued)

FOREIGN PATENT DOCUMENTS

| | | |
|---|---|---|
| DE | 102015217979 A1 | 3/2016 |
| EP | 3006835 A1 | 4/2016 |

*Primary Examiner* — Shawntina T Fuqua

(74) *Attorney, Agent, or Firm* — Jason Jones

(57) ABSTRACT

A cable includes a first wire-shaped metal conductor, a second metal conductor extending a predetermined distance away from and parallel to the first conductor, and a matrix made of a PTC material extending along the conductors, touching the latter and connecting them to one another electrically, with temperature-dependent electrical resistance and a positive temperature coefficient. At least one electrically insulating outer insulation layer surrounds the conductors and the matrix annularly. At least a third and a fourth metal conductor extend a predetermined distance away from and parallel to the first conductor, touch the matrix and are connected electrically by means of the latter to the first conductor, the second, the third and the fourth conductor being made in a wire shape and, considering the cross-section of the cable, being arranged distributed evenly over a circular track surrounding the first conductor.

17 Claims, 2 Drawing Sheets

(56) References Cited

U.S. PATENT DOCUMENTS

| | | | | |
|---|---|---|---|---|
| 4,317,001 | A | 2/1982 | Silver et al. | |
| 4,330,703 | A | 5/1982 | Horsma et al. | |
| 4,469,539 | A | 9/1984 | Wade et al. | |
| 4,486,252 | A | 12/1984 | Lloyd | |
| 4,626,618 | A | 12/1986 | Takaoka et al. | |
| 4,972,067 | A | 11/1990 | Lokar et al. | |
| 5,113,058 | A | 5/1992 | Srubas et al. | |
| 5,170,010 | A | 12/1992 | Aldissi | |
| 5,206,485 | A * | 4/1993 | Srubas | H05B 3/146 219/212 |
| 5,558,794 | A | 9/1996 | Jansens | |
| 6,410,651 | B1 | 6/2002 | Castellani et al. | |
| 6,455,769 | B1 | 9/2002 | Belli et al. | |
| 6,492,629 | B1 | 12/2002 | Sopory | |
| 6,525,119 | B2 | 2/2003 | Tsukada et al. | |
| 6,621,983 | B2 | 9/2003 | Thorin | |
| 6,703,593 | B2 | 5/2004 | Sopory | |
| 6,943,319 | B2 | 9/2005 | Jones | |
| 7,285,726 | B2 | 10/2007 | Bremnes | |
| 7,566,849 | B2 | 7/2009 | O'Connor | |
| 8,466,392 | B2 | 6/2013 | O'Connor | |
| 8,939,207 | B2 | 1/2015 | De St. Remey et al. | |
| 8,952,255 | B2 | 2/2015 | Osborg et al. | |
| 9,408,257 | B2 | 8/2016 | Lollar | |
| 2015/0221419 | A1 | 8/2015 | Gard et al. | |
| 2016/0300638 | A1 | 10/2016 | Wang et al. | |

* cited by examiner

HEATING CABLE

BACKGROUND OF THE TECHNOLOGY

The present technology relates generally to cables used in systems to heat floors, walls and other surfaces.

BRIEF SUMMARY OF THE TECHNOLOGY

In accordance with one aspect of the invention, a cable is provided that includes a first wire-shaped metal conductor (2), a second metal conductor (4) extending a predetermined distance away from and parallel to the first conductor (2), and a matrix (3) made of a PTC material extending along the conductors (2, 4), touching the latter and connecting them to one another electrically, with temperature-dependent electrical resistance and a positive temperature coefficient. At least one electrically insulating outer insulation layer (8) surrounds the conductors (2, 4) and the matrix annularly. At least a third and a fourth metal conductor (4) are provided which extend a predetermined distance away from and parallel to the first conductor (2), touch the matrix (3) and are connected electrically by means of the latter to the first conductor (2), the second, the third and the fourth conductor (4) being made in a wire shape and, considering the cross-section of the cable (1), being arranged distributed evenly over a circular track surrounding the first conductor (2).

In accordance with another aspect of the invention, a method of heating a surface is provided, including: obtaining a cable, the cable having a first metal conductor, a second metal conductor extending a predetermined distance away from and spirally laid relative to the first conductor, a matrix made of a PTC material extending along the conductors, touching the latter and connecting them to one another electrically, with temperature-dependent electrical resistance and a positive temperature coefficient, and at least one electrically insulating outer insulation layer surrounding the conductors and the matrix annularly; and installing the cable adjacent the surface.

DETAILED DESCRIPTION OF THE TECHNOLOGY

Figure 1:
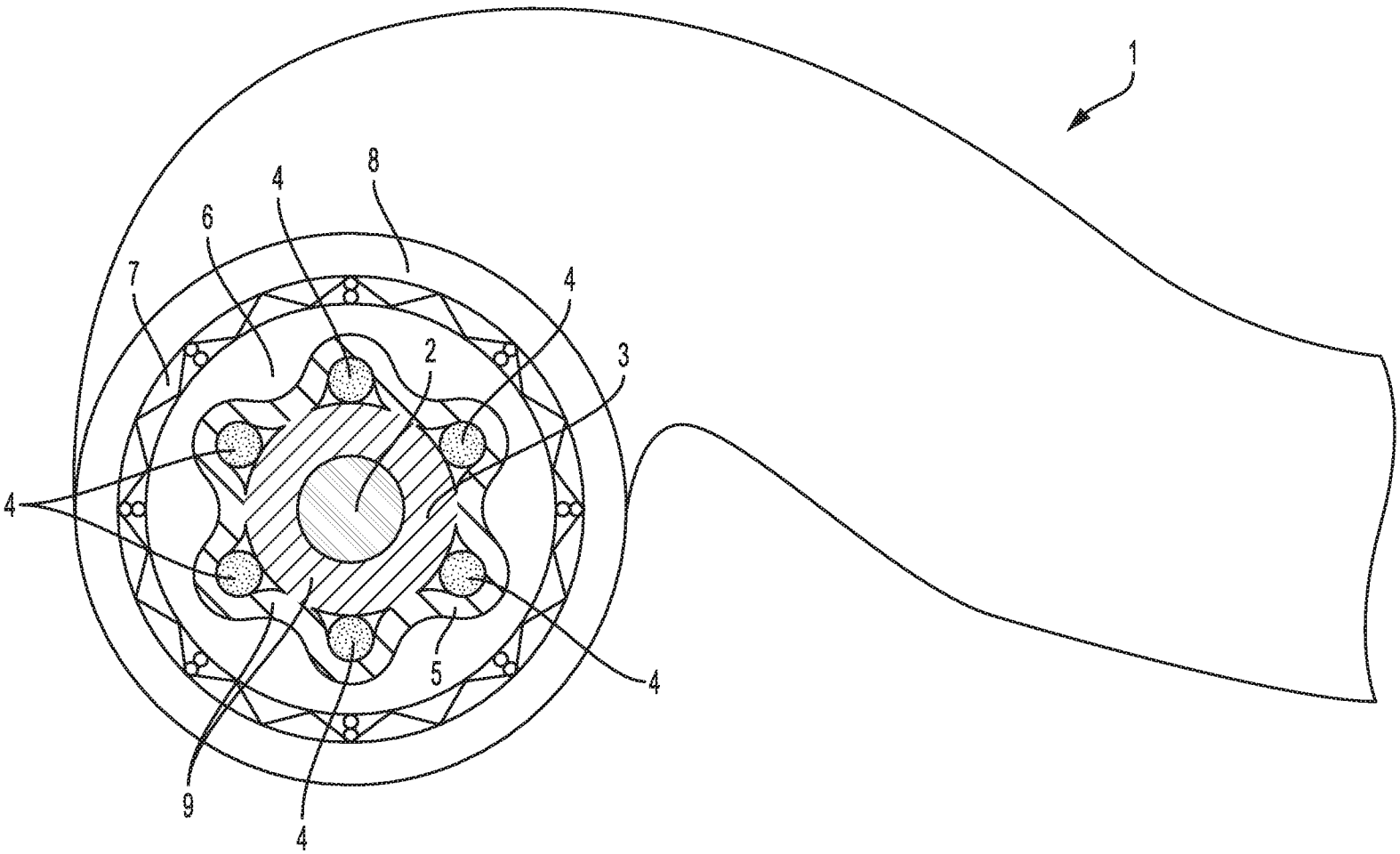
FIG. 1 is a diagrammatic view of a cable according to a first embodiment of the present invention and FIG. 2 is a diagrammatic view of a cable according to a second embodiment of the present invention.

The present invention relates to a cable comprising a first wire-shaped metal conductor, a second metal conductor extending a predetermined distance away from and parallel to the first conductor, a matrix made of a PTC (Positive Temperature Coefficient) material extending along the conductors, touching the latter and connecting them to one another electrically, with temperature-dependent electrical resistance and a positive temperature coefficient and at least one electrically insulating outer insulation layer surrounding the conductors and the matrix annularly. Furthermore, the invention relates to a specific use of this type of cable.

A cable of the type specified at the start is described, for example, in DE 10 2015 217 979 A1, which is used to transmit energy as well as to provide protection against over-current, over-voltage and over-heating. According to a first embodiment the cable has an oval cross-section and comprises two wire-like metal conductors extending a predetermined distance away from and parallel to one another, a matrix produced from a PTC material with temperature-dependent electrical resistance and a positive temperature coefficient embedding the two conductors and an outer insulation layer surrounding and electrically insulating the matrix. The two conductors are separated from one another spatially and are connected electrically to one another by means of the matrix so that a current can flow between the conductors, the PTC material of the matrix conducting electrical current better at low temperatures than at high temperatures. At low temperatures the cable can therefore conduct heat as well as a conventional cable. However, as temperatures rise the conductivity is greatly reduced, by means of which effective protection against over-current, over-voltage and over-heating is provided without separate protective devices being required for this purpose. According to a second embodiment the cable has a circular cross-section and comprises a first wire-like, centrally positioned metal conductor, a matrix made of PTC material that embeds the first conductor, a second metal conductor surrounding the matrix like a jacket (e.g., a metallic sheath or metallic wire braid or metallic wire grid) and contacting it, and an outer insulation layer surrounding the second conductor. Here too the two conductors are separated from one another spatially and are connected electrically to one another by means of the matrix so that a current can flow between them, the matrix acting as a temperature-dependent resistor.

A disadvantage of the first embodiment of the cable described in DE 10 2015 217 979 A1 is that this cable does not have a circular cross-section, and for some possible applications of the cable this is not desirable. A disadvantage of the second embodiment is that due to the fact that the second metal conductor and the outer insulation layer may both have different thermal expansion coefficients and elastic moduli than the matrix, said second metallic conductor may become detached from the matrix after repeated heating and cooling of the cable, and this leads to the desired electrical connection between the second conductor and the matrix worsening or being broken. Accordingly, correct function of the cable in the long term cannot be guaranteed.

Proceeding from this prior art, an object of the present invention is to devise a conductor of the type specified at the start with an alternative structure which at least partially eliminates the problems described above and/or improves the suitability of the cable for various applications.

In order to achieve this object the present invention devises a cable of the type specified at the start which is characterised in that the second and at least a third and a fourth metal conductor are provided which extend a predetermined distance away from the first conductor. The second, third and/or fourth conductors can be parallel to the first conductor. In one embodiment, the second, third and/or fourth conductors can be spirally laid around the first conductor. The second, third and/or fourth conductors can make contact with the matrix and can be electrically connected by means of the latter to the first conductor. The second, the third and the fourth conductor can be made in a wire shape and, considering the cross-section of the cable, can be arranged distributed evenly over a circular track, e.g., spirally laid around the first conductor. In other words, it is proposed to replace the second metal conductor made of a metallic sheath or metallic braid or grid described in the second embodiment of DE 10 2015 217 979 A1 with a number of wire-like conductors which, considered in cross-section, are arranged distributed evenly around the periphery of the first conductor, and apply an additional layer of preferably a PTC material over these wire-like conductors. The said additional layer of PTC material can be crosslinked together with the inner layer of PTC material surrounding the central metallic conductor, at a later stage in the process, and form a single, physically unitary matrix layer where the inner part and the outer part may have different conductivity versus temperature characteristics. The advantage of this is that the metallic conductors surrounding the central metallic conductor, and the central metallic conductor itself, are now all within one PTC matrix, and maintain good contact with the PTC matrix irrespective of its expansion and contraction during heating and cooling cycles.

According to a first version of the present invention, all of the conductors are fully embedded into a PTC material or matrix having a particular conductivity to temperature relationship or ratio.

According to a second version, the first conductor is fully embedded into a PTC material or matrix having a particular conductivity to temperature relationship or ratio, whereas the other conductors touch the said PTC material on its outer periphery and are coated with a covering layer which is made separately from the PTC material and is integrally connected to the latter by crosslinking, the covering layer possibly being made of a PTC material. At the end of the processes, the final product can consist of a single layer of PTC matrix, where the inner section between the central metallic conductor and the surrounding outer metallic conductors has a specific conductivity to temperature relationship or ratio, and the outer section of the PTC matrix has a different conductivity to temperature relationship or ratio, or none at all.

Both versions are characterised in that even after a very large number of temperature cycles, very good contact is obtained between the matrix and the conductors arranged on its outer periphery, by means of which correct function of the cable is ensured in the long term.

Preferably, the PTC material is a crosslinked plastic doped with carbon particles. This type of plastic has proven to be particularly suitable.

Advantageously, a protective conductor with an annular cross-section is provided which is disposed between an inner insulation layer surrounding the matrix and/or the covering layer annularly and the outer insulation layer. By providing this type of protective conductor acting as a ground shield, safety is increased.

According to one embodiment the cable according to the invention has a circular cross-section. Such a circular cross-section is very desirable for many applications.

Alternatively, the cable has a circular cross-section, wherein fillers or ridges radially project from the outer surface of the outer insulation layer, said ridges being arranged in equal distances from each other along the circumference of the cable jacket. Such ridges enlarge the outer diameter of the cable and enhance the gripping or clamping effect of the cable when arranged at napped cable carrier sheets, cable laying boards, concrete reinforcements and the like.

The cable preferably has an outer diameter in the range of from 4 to 16 mm.

Furthermore, the present invention proposes the use of a cable as a heating cable for surface heating in the form of floor, wall or ceiling heating, the cable having a first metal conductor, a second metal conductor extending a predetermined distance away from and parallel to the first conductor, a matrix made of a PTC material extending along the conductors, touching the latter and connecting them to one another electrically, with temperature-dependent electrical resistance and a positive temperature coefficient, and at least one electrically insulating outer insulation layer surrounding the conductors and the matrix annularly. The use of this type of cable as a heating cable for surface heating in the form of floor, wall or ceiling heating has the essential advantage that in areas in which the heat generated by the cable cannot be discharged sufficiently, the heat cannot accumulate to such an extent that over-heating of the cable is caused, for example in areas of a floor heating system where a fixed cabinet or fixed counter or low level furniture is located at that area. Up until now, such cables have not been used for said application because cables known to date either have an external form which can only be laid in a meandering shape with difficulty or with a large construction height or, with an appropriate shape of the known cable, correct function could not be guaranteed in the long term.

In the following same references denote same or similar components.

The cable 1 has a circular cross-section and comprises a centrally positioned first wire-like metal conductor 2, in particular a copper conductor, which is embedded in a matrix 3 made of a PTC material with temperature-dependent electrical resistance and a positive temperature coefficient. In the present case the PTC material is a crosslinked plastic doped with carbon particles, which touches the first conductor 2 peripherally. Furthermore, in this case the cable 1 comprises six additional wire-like metal conductors 4 which each extend a predetermined distance away from and parallel to or spirally laid around the first conductor 2, as considered in cross-section are arranged distributed evenly over a circular track surrounding the first conductor 2 and touch the matrix 3 on its outer periphery. Accordingly, the additional conductors 4 are electrically connected to the first conductor 2 by means of the matrix 3. The additional conductors 4 are coated with a covering layer 5 which is formed separately from the matrix 3 and are integrally connected to the latter in the areas respectively between two additional conductors 4 by a crosslinking process performed on matrix 3 and layer 5. Accordingly, each additional conductor 4 is embedded and integrated between the matrix 3 and the covering layer 5 which are both crosslinked and crosslinked together, forming a single matrix layer 9. In this case the covering layer 5 is produced from a different PTC material having a higher conductivity to temperature relationship than matrix 3 in order to optimise the electrical connection between all of the additional conductors 4. Alternatively however, a similar PTC material as matrix 3, or an electrically non-conductive plastic may also be chosen for the covering layer 5. The covering layer 5 is peripherally surrounded by an insulation layer 6 made of plastic which insulates electrically cable 1. Furthermore, a protective conductor 7 with an annular cross-section is provided which in this case is formed by braided copper and is surrounded by an electrically insulating outer insulation layer 8.

The cable 1 is particularly suitable for use as a heating cable for surface heating in the form of floor, wall or ceiling heating. By virtue of its circular cross-section the cable 1 can easily be laid, in particular on cable laying boards or membranes, as disclosed for example in EP 3 006 835 A1, without having to lay the cable 1 in any specific alignment. The same applies for clamping or fixing the cable 1 to screed carrier plates. By virtue of the arrangement according to the invention of the conductors 2 and 4 the outside diameter D of the cable 1 may prove to be very small and preferably comes within the range of 4 to 16 mm so that the surface heating only takes up a small construction height.

During operation a voltage is applied between the first conductor 2 and the additional conductors 4 so that the current flows from the first conductor 2, through the matrix 3, to the additional conductors 4 or vice versa. The matrix 3 heats up due to the flow of current, by means of which the desired heat output is provided. As the temperature increases the electrical conductivity of the PCT material decreases so that a maximum heating temperature cannot be exceeded. In areas where heat can only be discharged poorly, for example due to furniture that is positioned here, the decrease in conductivity may also take place locally so that a local accumulation of heat, and accordingly local over-heating of the cable, can be effectively counteracted.

Figure 2:
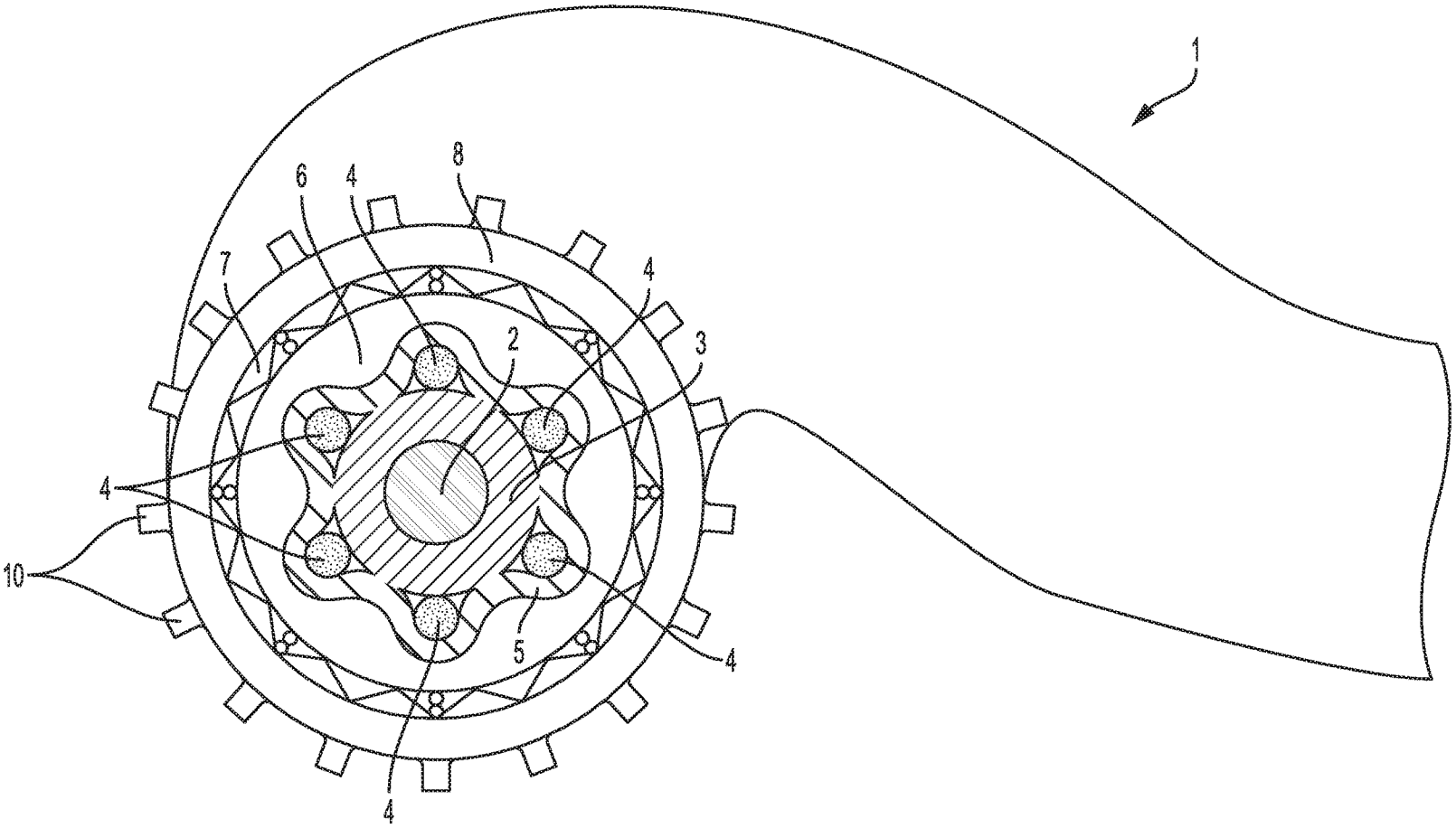

FIG. 2 shows a cable that essentially corresponds to the cable 1 shown in FIG. 1. In addition, the cable 1 of FIG. 2 comprises fillers or ridges 10 radially projecting from the outer surface of the cable jacket, such ridges 10 being arranged in equal distances from each other along the circumference of the cable jacket. Such ridges 10 enlarge the outer diameter of the cable 1 for applications where larger diameters are desirable, such as for fixing the cables 1 in napped carrier sheets, or boards that are usually used for installing heating pipes or heating conducts. Moreover, such ridges 10 enhance the gripping or clamping effect of the cable 1 when arranged at napped cable carrier sheets or plates, cable laying boards, concrete reinforcements and the like.

It should be clear that the embodiment described above only serves as an example and is not to be understood to be restrictive. In fact, changes and modifications are possible without straying from the scope of protection defined by the attached claims. Thus, all of the conductors 2 and 4 may also be embedded in the matrix 3, to give just one example. In this case one may dispense with the application of the covering layer 5.

The invention claimed is:

1. A cable (1), comprising:

a first wire-shaped metal conductor (2), a second metal conductor (4) extending a predetermined distance away from and parallel to the first conductor (2), a matrix (3) made of a PTC material extending along the conductors (2, 4), touching the latter and connecting them to one another electrically, with temperature-dependent electrical resistance and a positive temperature coefficient and at least one electrically insulating outer insulation layer (8) surrounding the conductors (2, 4) and the matrix annularly, wherein at least a third and a fourth metal conductor (4) are provided which extend a predetermined distance away from and parallel to the first conductor (2), touch the matrix (3) and are connected electrically by means of the latter to the first conductor (2), the second, the third and the fourth conductor (4) being made in a wire shape and, considering the cross-section of the cable (1), being arranged distributed evenly over a circular track surrounding the first conductor (2); wherein the first conductor (2) is fully embedded into the matrix (3), and the other conductors (4) touch the matrix (3) on its outer periphery and are coated with a covering layer (5) which is made separately from the matrix (3) and is integrally connected to the latter; and the covering layer (5) is integrally connected to the matrix (3) by crosslinking to form a matrix layer (9) having at least two sections with different electrical conductivity to temperature ratios.

2. The cable (1) according to claim 1, wherein the conductors (2, 4) are fully embedded into the matrix (3).

3. The cable (1) according to claim 1, wherein the covering layer (5) is produced from a PTC material.

4. The cable (1) according to claim 1, wherein the PTC material is a crosslinked plastic doped with carbon particles.

5. The cable (1) according to claim 1, further comprising a protective conductor (7) with an annular cross-section that is disposed between an inner insulation layer (6) surrounding the matrix (3) and/or a covering layer (5) annularly and the outer insulation layer (8).

6. The cable (1) according to claim 1, wherein said cable has a circular cross-section.

7. The cable (1) according to claim 6, wherein said cable has an outside diameter in the range of from 4 to 16 mm.

8. The cable (1) according to claim 1, wherein said cable (1) has a circular cross-section, wherein ridges (10) radially project from the outer surface of the cable jacket, said ridges (10) being arranged in equal distance from each other along the circumference of the cable jacket.

9. The cable (1) according to claim 8, wherein said cable has an outside diameter in the range of from 4 to 16 mm.

10. A cable (1), comprising:

a first wire-shaped metal conductor (2), a second metal conductor (4) extending a predetermined distance away from and parallel to the first conductor (2), a matrix (3) made of a PTC material extending along the conductors (2, 4), touching the latter and connecting them to one another electrically, with temperature-dependent electrical resistance and a positive temperature coefficient and at least one electrically insulating outer insulation layer (8) surrounding the conductors (2, 4) and the matrix annularly, wherein at least a third and a fourth metal conductor (4) are provided which extend a predetermined distance away from and parallel to the first conductor (2), touch the matrix (3) and are connected electrically by means of the latter to the first conductor (2), the second, the third and the fourth conductor (4) being made in a wire shape and, considering the cross-section of the cable (1), being arranged distributed evenly over a circular track surrounding the first conductor (2); wherein said cable (1) has a circular cross-section, wherein ridges (10) radially project from the outer surface of the cable jacket, said ridges (10) being arranged in equal distance from each other along the circumference of the cable jacket.

11. The cable (1) according to claim 10, wherein said cable has an outside diameter in the range of from 4 to 16 mm.

12. The cable (1) according to claim 10, wherein the conductors (2, 4) are fully embedded into the matrix (3).

13. The cable (1) according to claim 10, wherein the first conductor (2) is fully embedded into the matrix (3), and the other conductors (4) touch the matrix (3) on its outer periphery and are coated with a covering layer (5) which is made separately from the matrix (3) and is integrally connected to the latter.

14. The cable (1) according to claim 13, wherein the covering layer (5) is integrally connected to the matrix (3) by crosslinking to form a matrix layer (9) having at least two sections with different electrical conductivity to temperature ratios.

15. The cable (1) according to claim 13, wherein the covering layer (5) is produced from a PTC material.

16. The cable (1) according to claim 10, wherein the PTC material is a crosslinked plastic doped with carbon particles.

17. The cable (1) according to claim 10, further comprising a protective conductor (7) with an annular cross-section that is disposed between an inner insulation layer (6) surrounding the matrix (3) and/or a covering layer (5) annularly and the outer insulation layer (8).

* * * * *